US011432635B1

(12) United States Patent
Omodele

(10) Patent No.: US 11,432,635 B1
(45) Date of Patent: Sep. 6, 2022

(54) LOTION APPLICATION ASSEMBLY

(71) Applicant: Ojo Omodele, Arlington, TX (US)

(72) Inventor: Ojo Omodele, Arlington, TX (US)

( * ) Notice: Subject to any disclaimer, the term of this patent is extended or adjusted under 35 U.S.C. 154(b) by 0 days.

(21) Appl. No.: 17/242,480

(22) Filed: Apr. 28, 2021

(51) Int. Cl.

| | |
|---|---|
| ***A45D 34/04*** | (2006.01) |
| ***A45D 40/26*** | (2006.01) |
| ***A47K 5/12*** | (2006.01) |
| ***B05C 17/03*** | (2006.01) |
| ***B05C 17/02*** | (2006.01) |

(52) U.S. Cl.
CPC ..... *A45D 34/041* (2013.01); *A47K 5/1201* (2013.01); *A45D 40/261* (2013.01); *A45D 2200/1081* (2013.01); *B05C 17/0235* (2013.01); *B05C 17/03* (2013.01); *B05C 17/0316* (2013.01)

(58) Field of Classification Search
CPC .... A45D 34/041; A45D 40/261; A45D 40/26; A45D 34/04; A45D 33/12; A45D 2200/1081; A47K 5/1201; A47K 7/00; B05C 17/00; B05C 17/02; B05C 17/0205; B05C 17/025; B05C 17/03; B05C 17/0316; B05C 17/0235
USPC ..... 401/218–220, 6, 176, 179, 180
See application file for complete search history.

(56) References Cited

U.S. PATENT DOCUMENTS

| | | | | |
|---|---|---|---|---|
| 3,545,875 | A * | 12/1970 | Schneider | A47L 11/4041 222/414 |
| 6,129,469 | A | 10/2000 | Messer | |
| 6,210,057 | B1 | 4/2001 | Yannaci | |
| D498,022 | S | 11/2004 | Hanefeld | |
| 6,964,536 | B1 * | 11/2005 | Alhateeb | A45D 34/041 401/6 |
| 7,806,612 | B1 * | 10/2010 | Wangler | A46B 11/0024 401/176 |
| 9,743,806 | B2 * | 8/2017 | Iacuzio | A47J 37/106 |
| 10,448,724 | B1 | 10/2019 | Wendland | |
| 2007/0243005 | A1 | 10/2007 | Sviese | |
| 2015/0008240 | A1 | 1/2015 | Davis | |

* cited by examiner

*Primary Examiner* — David J Walczak

(57) ABSTRACT

A lotion application assembly includes a handle that is hollow and a roller that is rotatably coupled to the handle for rolling along a user's skin. A conduit is integrated into the handle and the conduit is directed toward the roller. A container is insertable into the handle, the container contains a fluid lotion and the container is in fluid communication with the conduit when the container is inserted into the handle. A cap is removably attachable to the handle and a plunger is slidably integrated into the cap. The plunger is urgeable into the container to urge the fluid lotion outwardly through the conduit and onto the roller thereby facilitating the roller to apply the fluid lotion onto the user's skin.

5 Claims, 5 Drawing Sheets

LOTION APPLICATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to application device and more particularly pertains to a new application device to apply lotion on a user's skin. The device includes a refillable container of lotion and a roller. Additionally, a plunger is included that urges lotion out of the container and onto the roller. In this way a user can apply the lotion to themselves with the roller.

(2) Description of Related Art Including Information Disclosed Under 37 CFR 1.97 and 1.98

The prior art relates to application devices including a variety of cleaning wands that include a reservoir for storing a fluid cleaning solution that is dispensed onto a cleaning panel. The prior art discloses a lotion dispenser that includes a plunger for urging lotion out of the lotion dispenser. In no instance does the prior art disclose a lotion dispenser that includes a roller, a plunger and a refillable container.

BRIEF SUMMARY OF THE INVENTION

An embodiment of the disclosure meets the needs presented above by generally comprising a handle that is hollow and a roller that is rotatably coupled to the handle for rolling along a user's skin. A conduit is integrated into the handle and the conduit is directed toward the roller. A container is insertable into the handle, the container contains a fluid lotion and the container is in fluid communication with the conduit when the container is inserted into the handle. A cap is removably attachable to the handle and a plunger is slidably integrated into the cap. The plunger is urgeable into the container to urge the fluid lotion outwardly through the conduit and onto the roller thereby facilitating the roller to apply the fluid lotion onto the user's skin.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
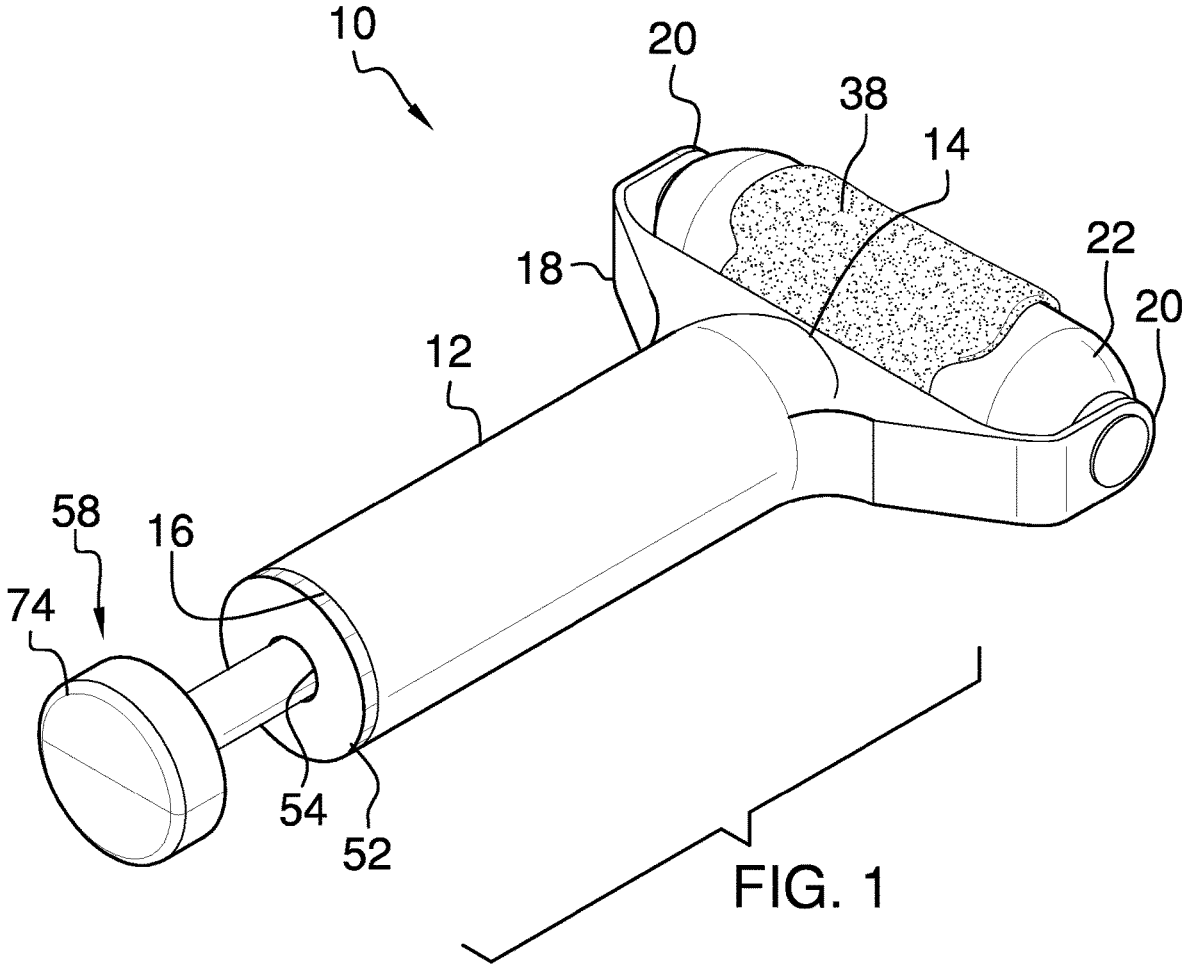
FIG. 1 is a perspective view of a lotion application assembly according to an embodiment of the disclosure.
Figure 2:
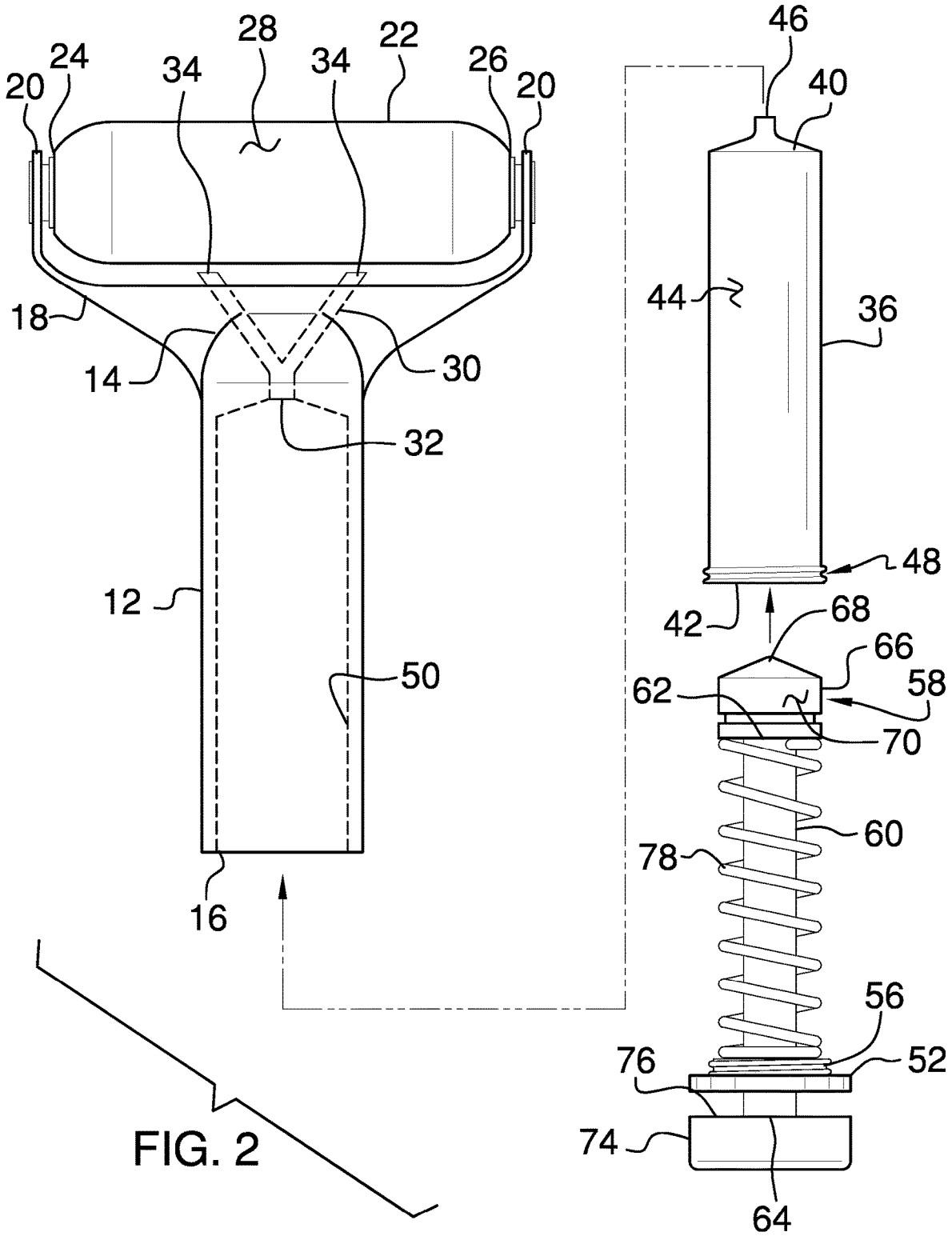
FIG. 2 is a top exploded view of an embodiment of the disclosure.
Figure 3:
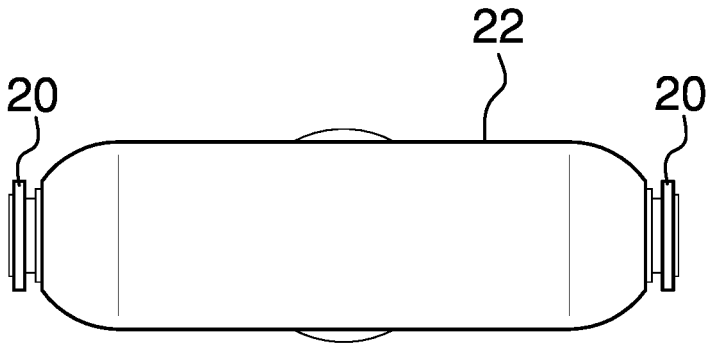
FIG. 3 is a front view of an embodiment of the disclosure.
Figure 4:
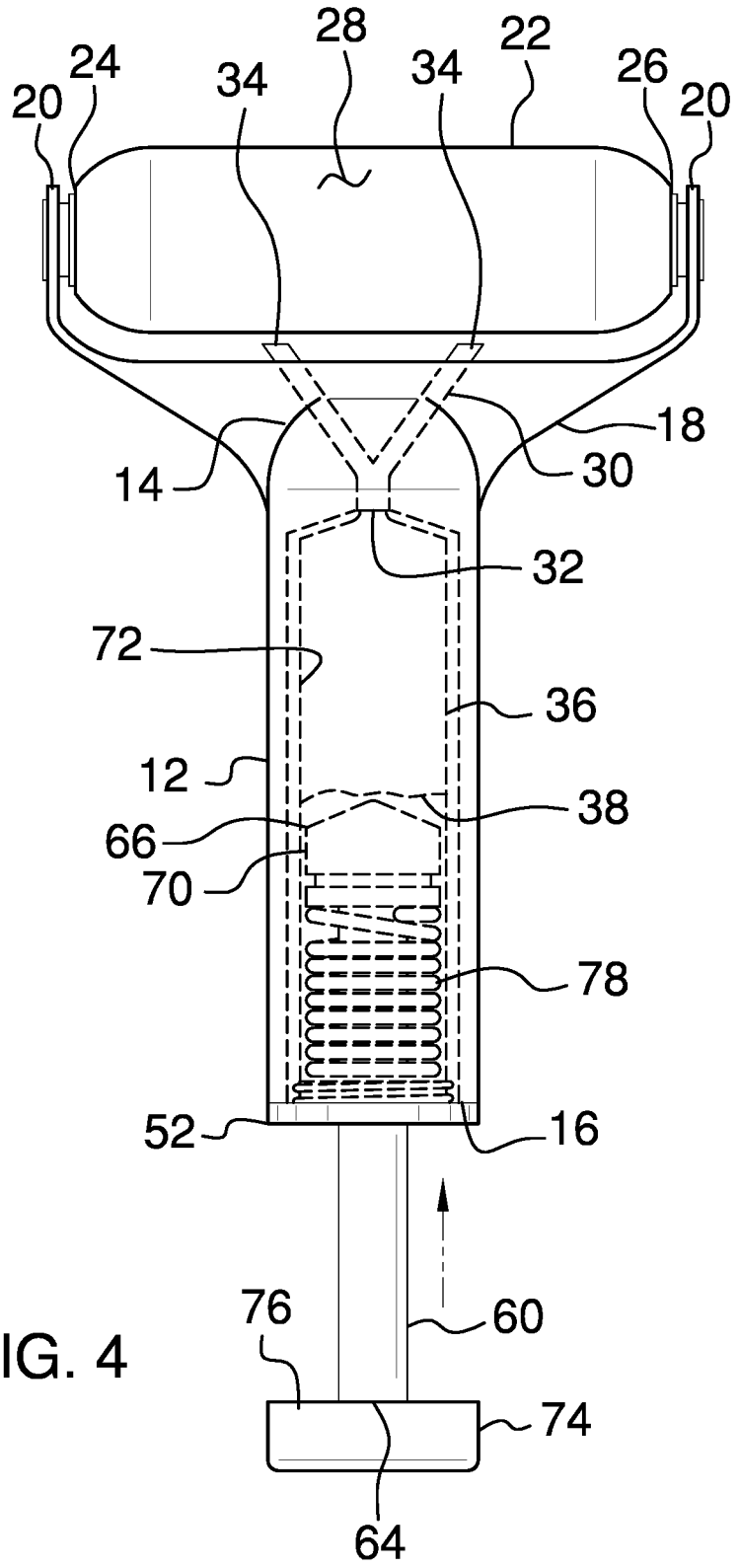
FIG. 4 is a top phantom view of an embodiment of the disclosure.
Figure 5:
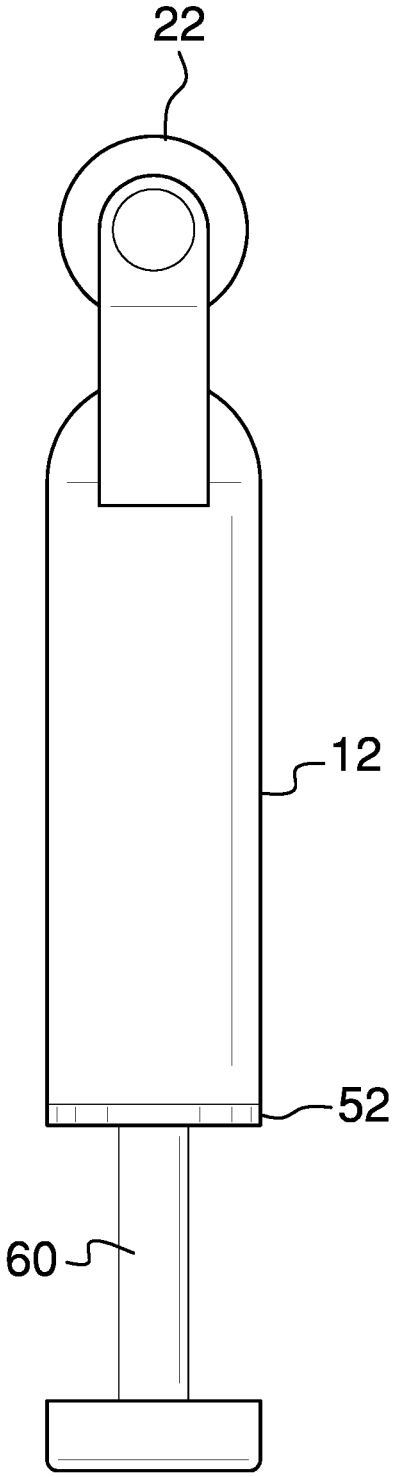
FIG. 5 is a right side view of an embodiment of the disclosure.

With reference now to the drawings, and in particular to FIGS. 1 through 5 thereof, a new application device embodying the principles and concepts of an embodiment of the disclosure and generally designated by the reference numeral 10 will be described.

As best illustrated in FIGS. 1 through 5, the lotion application assembly 10 generally comprises a handle 12 that is hollow and which has a first end 14 and a second end 16. A yoke 18 is integrated onto the first end 14 of the handle 12 and the yoke 18 has a pair of arms 20 that are spaced apart from each other. Additionally, the second end 16 is open to access an interior of the handle 12. A roller 22 is rotatably coupled to the handle 12 such that the roller 22 can be rolled along a user's skin. The roller 22 has a primary end 24, a secondary end 26 and an outer surface 28 extending therebetween, and each of the primary end 24 and the secondary end 26 is rotatably coupled to a respective one of the arms 20 of the yoke 18. Moreover, the roller 22 extends along an axis that is oriented perpendicular to an axis extending through the first end 14 and the second end 16 of the handle 12. The outer surface 28 of the roller 22 may be comprised of a resiliently compressible material such as rubber or other similar type of material.

A conduit 30 is integrated into the handle 12 and the conduit 30 has an inlet 32 and a pair of outlets 34. The inlet 32 extends into the interior of the handle 12 and each of the outlets 34 extends through the first end 14 of the handle 12. Moreover, each of the outlets 34 is directed toward the outer surface 28 of the roller 22. The conduit 30 may be a Y shaped conduit or the like to facilitate the inlet 32 to branch into the pair of outlets 34.

A container 36 is provided that can be filled with a fluid lotion 38. The fluid lotion 38 may be moisturizing lotion for skin or any other type of viscous skin treatment. The container 36 is insertable into the handle 12 and the container 36 is in fluid communication with the conduit 30 when the container 36 is inserted into the handle 12. The container 36 has a front end 40, a back end 42 and an outer surface 44 extending between the front end 40 and the back end 42. The front end 40 tapers into a nipple 46 and the nipple 46 passes the fluid lotion 38 out of the container 36.

The nipple 46 fluidly engages the inlet 32 of the conduit 30 when the container 36 is inserted into the handle 12 to receive the fluid lotion 38. The outer surface 44 of the container 36 has a threaded portion 48 adjacent to the back end 42 of the container 36. The threaded portion 48 threadably engages an inside surface 50 of the handle 12 to seat the container 36 in the handle 12. Additionally, the back end 42 of the container 36 is aligned with the second end 16 of the handle 12 when the container 36 is seated in the handle 12. A cap 52 is provided and the cap 52 is removably attachable to the handle 12. The cap 52 has an opening 54 extending through the cap 52 and the cap 52 has a threaded perimeter edge 56. The threaded perimeter edge 56 of the cap 52 threadably engages the inside surface 50 of the container 36 having the cap 52 covering the second end 16 of the handle 12.

A plunger 58 is slidably integrated into the cap 52 and the plunger 58 can be manipulated by a user. The plunger 58 is urgeable into the container 36 to urge the fluid lotion 38 outwardly through the conduit 30 and onto the roller 22. In this way the roller 22 can apply the fluid lotion 38 onto the user's skin. The plunger 58 includes a rod 60 that has a first end 62 and a second end 64, and the rod 60 extends through the opening 54 in the cap 52.

The plunger 58 includes a plug 66 that is coupled to the first end 62 of the rod 60, and the plug 66 has a distal end 68 with respect to the rod 60 and an outside surface 70. The distal end 68 tapers to a point and the outside surface 70 engages an inside surface 72 of the container 36 to urge the fluid lotion 38 into the conduit 30 when the rod 60 is urged into the container 36. Additionally, the tapered point of the distal end 68 conforms to the taper of the front end 40 of the container 36 when the plug 66 is fully inserted into the container 36. In this way the plug 66 facilitates the entirety of the fluid lotion 38 to be urged from the container 36.

The plunger 58 includes a disk 74 that has a first surface 76. The first surface 76 is coupled to the second end 64 of the rod 60 such that the disk 74 can be manipulated by a user. The plunger 58 includes a biasing member 78 that is coupled between the plug 66 and the cap 52. The biasing member 78 biases the plug 66 toward the cap 52 when the rod 60 is not is urged into the container 36. The biasing member 78 may be a coiled spring that is biased into compressed position and which can be stretched into an un-compressed position.

In use, the container 36 is filled with the fluid lotion 38 and the container 36 is threaded into the handle 12. The rod 60 is inserted into the container 36 and the cap 52 is threaded onto the handle 12. The rod 60 is urged into the handle 12 to squeeze the fluid lotion 38 onto the roller 22. In this way the roller 22 can apply the fluid lotion 38 to the user's skin when the user rolls the roller 22 along their skin. The container 36 can be refilled each time that the container 36 is depleted of the fluid lotion 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lotion application assembly for applying lotion on a user's skin, said assembly comprising:

a handle being hollow, said handle having a first end and a second end, said handle having a yoke being integrated onto said first end;

a roller being rotatably coupled to said yoke wherein said roller is configured to be rolled along a user's skin;

a conduit being integrated into said handle, said conduit being directed toward said roller;

a container being configured to be filled with a fluid lotion, said container being insertable into said handle, said container being in fluid communication with said conduit when said container is inserted into said handle;

a cap being removably attachable to said handle;

a plunger being slidably integrated into said cap wherein said plunger is configured to be manipulated by a user, said plunger being urgeable into said container wherein said plunger is configured to urge the fluid lotion outwardly through said conduit and onto said roller thereby facilitating said roller to apply the fluid lotion onto the user's skin;

wherein said handle has an inside surface;

wherein said cap has an opening extending through said cap, said cap having a threaded perimeter edge, said threaded perimeter edge of said cap threadably engaging said inside surface of said handle having said cap covering said second end of said handle; and wherein said plunger includes:

a rod having a first end and a second end, said rod extending through said opening in said cap; and a plug being coupled to said first end of said rod, said plug having a distal end with respect to said rod and an outside surface, said distal end tapering to a point, said outside surface engaging said inside surface of said container wherein said plug is configured to urge the fluid lotion into said conduit when said rod is urged into said container.

2. The assembly according to claim 1, wherein:

said yoke has a pair of arms being spaced apart from each other, said second end being open to access an interior of said handle;

said roller has a primary end, a secondary end and an outer surface extending therebetween, each of said primary end and said secondary end being rotatably coupled to a respective one of said arms of said yoke, said roller extending along an axis being oriented perpendicular to an axis extending through said first end and said second end of said handle; and said conduit has an inlet and a pair of outlets, said inlet extending into said interior of said handle, each of said outlets extending through said first end of said handle such that each of said outlets is directed toward said roller.

3. The assembly according to claim 2, wherein said container has a front end, a back end and an outer surface extending between said front end and said back end, said front end tapering into a nipple wherein said nipple is configured to pass the fluid lotion out of said container, said nipple fluidly engaging said inlet of said conduit when said container is inserted into said handle wherein said conduit is configured to receive the fluid lotion, said outer surface of said container having a threaded portion adjacent to said back end of said container, said threaded portion threadably engaging an inside surface of said handle to seat said container in said handle, said back end of said container being aligned with said second end of said handle when said container is seated in said handle.

4. The assembly according to claim 1, wherein said plunger includes:

a disk having a first surface, said first surface being coupled to said second end of said rod wherein said disk is configured to be manipulated by a user; and a biasing member being coupled between said plug and said cap, said biasing member biasing said plug toward said cap when said rod is not being urged into said container.

5. A lotion application assembly for applying lotion on a user's skin, said assembly comprising:

a handle being hollow, said handle having a first end and a second end, said handle having a yoke being integrated onto said first end, yoke having a pair of arms being spaced apart from each other, said second end being open to access an interior of said handle;

a roller being rotatably coupled to said yoke wherein said roller is configured to be rolled along a user's skin, said roller having a primary end, a secondary end and an outer surface extending therebetween, each of said primary end and said secondary end being rotatably coupled to a respective one of said arms of said yoke, said roller extending along an axis being oriented perpendicular to an axis extending through said first end and said second end of said handle;

a conduit being integrated into said handle, said conduit having an inlet and a pair of outlets, said inlet extending into said interior of said handle, each of said outlets extending through said first end of said handle such that each of said outlets is directed toward said roller;

a container being configured to be filled with a fluid lotion, said container being insertable into said handle, said container being in fluid communication with said conduit when said container is inserted into said handle, said container having a front end, a back end and an outer surface extending between said front end and said back end, said front end tapering into a nipple wherein said nipple is configured to pass the fluid lotion out of said container, said nipple fluidly engaging said inlet of said conduit when said container is inserted into said handle wherein said conduit is configured to receive the fluid lotion, said outer surface of said container having a threaded portion adjacent to said back end of said container, said threaded portion threadably engaging an inside surface of said handle to seat said container in said handle, said back end of said container being aligned with said second end of said handle when said container is seated in said handle;

a cap being removably attachable to said container, said cap having an opening extending through said cap, said cap having a threaded perimeter edge, said threaded perimeter edge of said cap threadably engaging said inside surface of said handle having said cap covering said second end of said handle;

a plunger being slidably integrated into said cap wherein said plunger is configured to be manipulated by a user, said plunger being urgeable into said container wherein said plunger is configured to urge the fluid lotion outwardly through said conduit and onto said roller thereby facilitating said roller to apply the fluid lotion onto the user's skin, said plunger including:

a rod having a first end and a second end, said rod extending through said opening in said cap;

a plug being coupled to said first end of said rod, said plug having a distal end with respect to said rod and an outside surface, said distal end tapering to a point, said outside surface engaging an inside surface of said container wherein said plug is configured to urge the fluid lotion into said conduit when said rod is urged into said container;

a disk having a first surface, said first surface being coupled to said second end of said rod wherein said disk is configured to be manipulated by a user; and a biasing member being coupled between said plug and said cap, said biasing member biasing said plug toward said cap when said rod is not being urged into said container.

* * * * *